US012622467B2

(12) United States Patent
Tang et al.

(10) Patent No.: US 12,622,467 B2
(45) Date of Patent: May 12, 2026

(54) ELECTRONIC-CIGARETTE VAPORIZATION COMPONENT AND ELECTRONIC CIGARETTE

(71) Applicant: BYD PRECISION MANUFACTURE CO., LTD., Shenzhen (CN)

(72) Inventors: Jianguo Tang, Shenzhen (CN); Qibin Jin, Shenzhen (CN); Yinbo Lu, Shenzhen (CN); Guiping Hou, Shenzhen (CN)

(73) Assignee: BYD PRECISION MANUFACTURE CO., LTD., Shenzhen (CN)

( * ) Notice: Subject to any disclaimer, the term of this patent is extended or adjusted under 35 U.S.C. 154(b) by 398 days.

(21) Appl. No.: 18/344,887

(22) Filed: Jun. 30, 2023

(65) Prior Publication Data

US 2023/0337749 A1 Oct. 26, 2023

Related U.S. Application Data

(63) Continuation of application No. PCT/CN2023/082975, filed on Mar. 22, 2023.

(30) Foreign Application Priority Data

Mar. 29, 2022 (CN) ..... 202220716355.0

(51) Int. Cl.
*A24F 40/485* (2020.01)
*A24F 40/10* (2020.01)
*A24F 40/46* (2020.01)

(52) U.S. Cl.
CPC ..... *A24F 40/485* (2020.01); *A24F 40/10* (2020.01); *A24F 40/46* (2020.01)

(58) Field of Classification Search
None
See application file for complete search history.

(56) References Cited

U.S. PATENT DOCUMENTS 11,297,881 B2 4/2022 Qiu
11,583,002 B2 2/2023 Zhu
(Continued)

FOREIGN PATENT DOCUMENTS

CN 206079041 U 4/2017
CN 211048396 U 7/2020
(Continued)

OTHER PUBLICATIONS

European Search Opinion dated Jul. 5, 2024 in European Application No. EP23732803A filed Mar. 22, 2023 (Year: 2024).*
(Continued)

*Primary Examiner* — Manley L Cummins, IV

(57) ABSTRACT

An electronic-cigarette vaporization component includes a housing, a vaporization core fixing device, and a vaporization core component. The housing has a liquid storage cavity, an outlet channel, and a vaporization cavity in communication with the outlet channel. An air inlet in communication with the vaporization cavity and an air outlet in communication with the outlet channel are provided on the housing. The vaporization core fixing device is arranged in the housing and formed with a mounting groove and a communication channel. The vaporization cavity has a first end in communication and a second end in communication with one end of the outlet channel distant from the air outlet. At least a portion of the communication channel is arranged obliquely with respect to the outlet channel. The vaporization core component is mounted in the mounting groove and in communication with the liquid storage cavity and the vaporization cavity respectively.

17 Claims, 6 Drawing Sheets

(56) References Cited

U.S. PATENT DOCUMENTS

| | | | | |
|---|---|---|---|---|
| 2016/0135505 | A1 | 5/2016 | Li et al. | |
| 2020/0288778 | A1 | 9/2020 | Kim et al. | |
| 2020/0345066 | A1 | 11/2020 | Kim et al. | |
| 2020/0367558 | A1 | 11/2020 | Zhu | |
| 2023/0165303 | A1* | 6/2023 | Liu | A24F 40/42 131/329 |
| 2023/0337750 | A1* | 10/2023 | Tang | A24F 40/42 |
| 2023/0346035 | A1* | 11/2023 | Zhou | A24F 40/485 |
| 2023/0380497 | A1* | 11/2023 | Li | A24F 40/485 |

FOREIGN PATENT DOCUMENTS

| | | | |
|---|---|---|---|
| CN | 111955802 | A | 11/2020 |
| CN | 211910515 | U | 11/2020 |
| CN | 212437274 | U | 2/2021 |
| CN | 113317561 | A | 8/2021 |
| CN | 214127021 | U | 9/2021 |
| CN | 113841928 | A | 12/2021 |
| CN | 215075497 | U | 12/2021 |
| CN | 113925219 | A | 1/2022 |
| CN | 215736927 | U | 2/2022 |
| CN | 216088865 | U | 3/2022 |
| CN | 217986687 | U | 12/2022 |
| EP | 4275524 | A1 | 11/2023 |
| KR | 20200141227 | A | 12/2020 |

OTHER PUBLICATIONS

International Search Report dated Apr. 27, 2023 in International Application No. PCT/CN2023/082975. English translation attached.
Written Opinion of the ISA dated Apr. 27, 2023 in International Application No. PCT/CN2023/082975. English translation attached.
Extended European Search Report from corresponding European Application No. EP23732803.4, dated Jul. 5, 2024.

* cited by examiner

ELECTRONIC-CIGARETTE VAPORIZATION COMPONENT AND ELECTRONIC CIGARETTE

CROSS-REFERENCE TO RELATED APPLICATION

The present application is a continuation of International Application No. PCT/CN2023/082975, filed on Mar. 22, 2023, which claims priority to and benefits of Chinese Patent Application No. 202220716355.0, filed on Mar. 29, 2022. The entire content of the above-referenced applications is incorporated herein by reference.

FIELD

The present disclosure relates to the technical field of electronic cigarettes, and particularly to an electronic-cigarette vaporization component and an electronic cigarette.

BACKGROUND

Electronic cigarettes, as a substitute for traditional tobacco, can not only simulate the sensory experience of smoking, but also do far less damage to health than smoking traditional tobacco, so the demand for electronic cigarettes is increasing year by year.

An electronic cigarette usually includes a cartridge and a cigarette rod. Power is supplied to a vaporization core in the cartridge through the cigarette rod, and an e-liquid is heated and vaporized by the vaporization core into an aerosol for a user to inhale. Existing electronic cigarettes have a large number of components and limited internal space. How to properly design the internal structure of electronic cigarettes to realize miniaturization without affecting the taste of aerosol is an important factor that those skilled in the art need to consider. Therefore, it is necessary to improve the internal structure of electronic cigarettes.

SUMMARY

The present disclosure aims to at least solve one of the technical problems in the related art. Therefore, an objective of the present disclosure is to provide an electronic-cigarette vaporization component, to realize the miniaturization design of electronic cigarettes, reduce the resistance to inhalation of electronic cigarettes, ensure the taste of aerosol, and improve user experience.

Another objective of the present disclosure is to provide an electronic cigarette using the electronic-cigarette vaporization component.

An embodiment of a first aspect of the present disclosure provides an electronic-cigarette vaporization component, including: a housing, where the housing has a liquid storage cavity provided therein, an outlet channel, and a vaporization cavity in communication with the outlet channel, and an air inlet in communication with the vaporization cavity and an air outlet in communication with the outlet channel are provided on the housing; a vaporization core fixing device, where the vaporization core fixing device is fixed in the housing, the liquid storage cavity is separated from the vaporization cavity by the vaporization core fixing device, the vaporization core fixing device is provided with a mounting groove and a communication channel, a first end of the communication channel is in communication with the vaporization cavity, a second end of the communication channel is in communication with one end of the outlet channel distant from the air outlet, and at least a portion of the communication channel is arranged obliquely with respect to the outlet channel; and a vaporization core component, where the vaporization core component is mounted in the mounting groove, and the vaporization core component is in communication with the liquid storage cavity and the vaporization cavity respectively.

The electronic-cigarette vaporization component according to the embodiment of the present disclosure not only realizes the miniaturization design of the electronic-cigarette vaporization component, but also can reduce the resistance to inhalation of electronic cigarettes, and improve user experience without affecting the taste of aerosol.

According to some embodiments of the present disclosure, the first end of the communication channel is located between the mounting groove and an inner side wall of the housing, and a central axis of the first end of the communication channel is closer to the inner side wall of the housing than a central axis of the outlet channel is.

According to some embodiments of the present disclosure, the housing has a length direction, a width direction, and a thickness direction, a maximum dimension of the housing in the length direction is larger than a maximum dimension of the housing in the width direction, and the maximum dimension of the housing in the width direction is larger than or equal to a maximum dimension of the housing in the thickness direction.

According to some embodiments of the present disclosure, in the width direction, the first end of the communication channel is located on one side of the mounting groove, and at least a portion of the communication channel is arranged obliquely with respect to the outlet channel in the width direction.

According to some embodiments of the present disclosure, the communication channel includes a second channel segment and a second connecting segment in communication with each other, and the second channel segment is inclined in the width direction with respect to the outlet channel; and the second connecting segment is sleeved on an outer peripheral side of the end of the outlet channel distant from the air outlet.

According to some embodiments of the present disclosure, an included angle between a central axis of the second channel segment and the central axis of the outlet channel ranges from 20° to 70°, and a central axis of the second connecting segment coincides with the central axis of the outlet channel.

According to some embodiments of the present disclosure, the vaporization core fixing device includes: a fixing portion, where the mounting groove is formed on the fixing portion, a communication hole is formed in the fixing portion, and the communication hole is located on one side of the mounting groove in the width direction; and a channel portion, where the channel portion is located on one side of the fixing portion in the length direction, the channel portion includes a first channel segment and a first connecting segment, the first channel segment and the communication hole are in communication with each other to form the second channel segment, and the first connecting segment forms the second connecting segment.

According to some embodiments of the present disclosure, an inner a wall of the communication hole is inclined toward the outlet channel in the width direction, the first channel segment obliquely extends from the fixing portion toward the outlet channel in the width direction, and the inner wall of the communication hole and an inner wall of the first channel segment are connected to each other to form an inner wall of the second channel segment.

According to some embodiments of the present disclosure, a cross-sectional area of the second connecting segment is larger than a cross-sectional area of the second channel segment.

According to some embodiments of the present disclosure, a connecting wall is connected between a side wall of the second connecting segment and a side wall of the second channel segment, and an end surface of the end of the outlet channel distant from the air outlet presses against the connecting wall.

According to some embodiments of the present disclosure, a sealing sleeve is sleeved on the side wall of the second connecting segment, the sealing sleeve is arranged surrounding the outlet channel, and the sealing sleeve is at least partially located between an inner wall surface of the side wall of the second connecting segment and an outer wall surface of the outlet channel.

According to some embodiments of the present disclosure, the sealing sleeve includes a first sealing wall, a second sealing wall, and an end edge connecting the first sealing wall and the second sealing wall; an annular groove is defined by the first sealing wall, the second sealing wall, and the end edge, and the side wall of the second connecting segment is inserted into the annular groove.

According to some embodiments of the present disclosure, the first sealing wall is in interference fit with an outer wall of the outlet channel and the inner wall surface of the side wall of the second connecting segment respectively, the second sealing wall is in interference fit with an inner wall of the housing and an outer wall surface of the side wall of the second connecting segment respectively in the thickness direction of the housing, and the end edge presses against a top wall of the second connecting segment.

According to some embodiments of the present disclosure, a sealing rib is arranged on a side surface of the first sealing wall facing the outlet channel, and the sealing rib is arranged surrounding the outlet channel.

According to some embodiments of the present disclosure, a cross-section of the outlet channel is circular, elliptical, or racetrack-shaped.

According to some embodiments of the present disclosure, in the length direction, the housing and the vaporization core component have a central axis, and the central axis of the outlet channel, the central axis of the housing, and the central axis of the vaporization core component coincide with each other.

According to some embodiments of the present disclosure, in the length direction, the housing and the vaporization core component have a central axis, the central axis of the housing coincides with the central axis of the vaporization core component, the central axis of the outlet channel is deviated by a predetermined distance from the central axis of the housing and the central axis of the vaporization core component, and the first end of the communication channel is located on one side of the mounting groove distant from the outlet channel in the width direction.

According to some embodiments of the present disclosure, the vaporization core component includes: a vaporization core, where the vaporization core includes a porous body and a heating element arranged on the porous body, the porous body includes a liquid guiding portion and a vaporization portion, the liquid guiding portion is in communication with the liquid storage cavity, the vaporization portion is in communication with the vaporization cavity, a projected area of the liquid guiding portion is smaller than a projected area of the vaporization portion in a direction perpendicular to the length direction, and a step surface is formed between the liquid guiding portion and the vaporization portion; and a vaporization-core sealing member, where the vaporization-core sealing member is sleeved on an outer peripheral edge of the porous body, the vaporization-core sealing member includes a first sealing edge, a second sealing edge, and a sealing connecting portion connected between the first sealing edge and the second sealing edge, the first sealing edge covers an outer edge of a side surface of the liquid guiding portion facing the liquid storage cavity, the second sealing edge covers the step surface, and the sealing connecting portion covers a side surface of the liquid guiding portion.

According to some embodiments of the present disclosure, in the length direction, the liquid guiding portion and the vaporization portion each have a thickness dimension, the thickness dimension of the liquid guiding portion is 0.5 mm to 5 mm, and the thickness dimension of the vaporization portion is 0.3 mm to 3 mm.

According to some embodiments of the present disclosure, a stop portion is constructed on a side wall of the mounting groove, and the stop portion is stopped against a side surface of the second sealing edge facing the outlet channel in the length direction.

According to some embodiments of the present disclosure, the vaporization core fixing device further includes an air exchange cavity, the air exchange cavity and the communication hole are located on two sides of the mounting groove in the width direction, an air exchange through hole is formed on a cavity wall of the air exchange cavity, the air exchange cavity is in communication with the vaporization cavity through the air exchange through hole, an air exchange groove is formed on an outer peripheral surface of one side, where the air exchange cavity is provided, of the vaporization core fixing device, one end of the air exchange groove is connected with the air exchange through hole, and another end of the air exchange groove runs through a side surface of the vaporization core fixing device facing the liquid storage cavity to be in communication with the liquid storage cavity.

According to some embodiments of the present disclosure, the electronic-cigarette vaporization component further includes a first sealing member, the first sealing member is sleeved on the vaporization core fixing device, the first sealing member is at least partially located between an inner wall surface of the housing and the vaporization core fixing device, and an air exchange channel is defined jointly by the air exchange through hole, the air exchange groove, and the first sealing member.

According to some embodiments of the present disclosure, the air exchange through hole is formed on one side of the vaporization core fixing device in the thickness direction, a part of the air exchange groove extends to another side of the vaporization core fixing device in the thickness direction, and the another end of the air exchange groove is located at one end of the vaporization core fixing device in the width direction.

According to some embodiments of the present disclosure, the first sealing member includes: a sealing end portion, where the sealing end portion covers at least an edge portion of the side surface of the vaporization core fixing device facing the liquid storage cavity; and a first sealing portion and a second sealing portion, where the first sealing portion and the second sealing portion are both connected with the sealing end portion and are located on an outer peripheral side of the vaporization core fixing device, the air exchange channel is provided between the first sealing portion and the vaporization core fixing device, and a maximum dimension of the second sealing portion in the length direction of the housing is smaller than a maximum dimension of the first sealing portion in the length direction of the housing.

According to some embodiments of the present disclosure, the sealing end portion includes at least one air exchange elastic portion; the at least one air exchange elastic portion covers one end of the air exchange channel facing the liquid storage cavity; when a pressure in the vaporization cavity is greater than a pressure in the liquid storage cavity, the air exchange elastic portion deforms under a pressure difference between the vaporization cavity and the liquid storage cavity to open the air exchange channel; and when the pressure in the vaporization cavity is not greater than the pressure in the liquid storage cavity, the air exchange channel is blocked by the air exchange elastic portion.

According to some embodiments of the present disclosure, a stop step is provided on an inner wall surface of one side of the housing close to the first sealing portion, and on one side of the housing close to the communication hole, a side surface of the sealing end portion facing the air outlet is stopped against the stop step.

According to some embodiments of the present disclosure, a protruding bar is provided on an inner wall surface of one side of the housing close to the second sealing portion, and the protruding bar presses against the sealing end portion in the length direction.

According to some embodiments of the present disclosure, the housing includes: a housing body, where the outlet channel is provided in the housing body, one end of the housing body is provided with an opening, and another end of the housing body is provided with the air outlet; and a lower cover, where the lower cover is arranged at the opening, the vaporization cavity is defined jointly by the housing body, the vaporization core component, and the lower cover, the lower cover includes a bottom wall and a side wall extending from the bottom wall toward the vaporization cavity, the bottom wall of the lower cover is provided with an inlet channel, the inlet channel includes an air intake hole and an air outlet, the air intake hole forms the air inlet, and the air outlet is deviated in a direction away from the communication hole relative to the air intake hole.

According to some embodiments of the present disclosure, an edge of one side of the second sealing edge close to the communication channel has a shielding portion extending in the length direction, the shielding portion extends into the vaporization cavity, and the shielding portion is arranged at a communication position between the vaporization cavity and the communication channel, to limit an airflow at the communication position.

According to some embodiments of the present disclosure, the bottom wall of the lower cover is provided with a conductive pin, an e-liquid guide cotton is supported by the side wall of the lower cover, the conductive pin penetrates the e-liquid guide cotton and presses against the vaporization core component to electrically connect to the vaporization core, the e-liquid guide cotton has a vent hole, and a position of the vent hole corresponds to a position of the air outlet.

According to some embodiments of the present disclosure, the electronic-cigarette vaporization component further includes an air-guiding metal plate, where the air-guiding metal plate is arranged on a side surface of the e-liquid guide cotton facing the vaporization core component, the air-guiding metal plate covers the air outlet, and the air-guiding metal plate is provided with a plurality of air splitting holes at a position corresponding to the air outlet.

According to some embodiments of the present disclosure, the air guide metal plate is provided with a notch at a position exactly facing the air exchange cavity and the communication hole.

An embodiment of a second aspect of the present disclosure provides an electronic cigarette, including the electronic-cigarette vaporization component according to the embodiment of the first aspect of the present disclosure.

Additional aspects and advantages of the present disclosure will be partly given in and partly apparent from the description below, or understood through practice of the present disclosure.

BRIEF DESCRIPTION OF THE DRAWINGS

The above and/or other additional aspects and advantages of the present disclosure become apparent and comprehensible from the description of embodiments in connection with accompanying drawings, in which.

LIST OF REFERENCE NUMERALS

Figure 1:
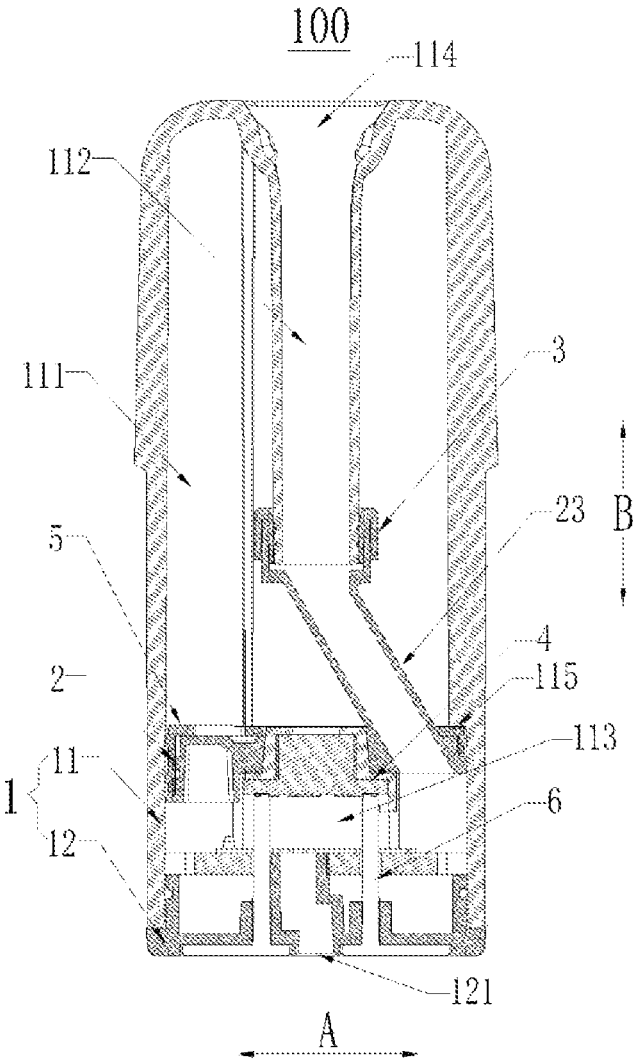
FIG. 1 is a schematic diagram of an electronic-cigarette vaporization component according to an embodiment of the present disclosure.

100: vaporization component;

1: housing; 11: housing body; 111: liquid storage cavity; 112: outlet channel; 113: vaporization cavity;

114: air outlet; 115: stop step; 12: lower cover; 121: air inlet;

2: vaporization core fixing device; 21: fixing portion; 211: mounting groove; 212: communication hole; 213: stop portion;

214: air exchange cavity; 215: air exchange through hole; 216: air exchange groove; 22: channel portion; 221: first channel segment; 222: first connecting segment; 23: communication channel; 231: second channel segment; 232: second connecting segment;

3: sealing sleeve; 31: first sealing wall; 32: end edge; 33: second sealing wall; 34: annular groove; 311: sealing rib; 4: vaporization core component; 41: vaporization core; 411: porous body, 4111: liquid guiding portion; 4112: vaporization portion; 4113: step surface; 412: heating element; 42: vaporization-core sealing member; 421: first sealing edge; 422: sealing connecting portion; 423: second sealing edge; 5: first sealing member; 51: first sealing portion; 52: sealing end portion; 521: air exchange elastic portion; 53: second sealing portion; 6: conductive pin; 7: e-liquid guide cotton; 8: air-guiding metal plate.

DETAILED DESCRIPTION

Embodiments of the present disclosure will be described in detail below. The embodiments described with reference to the accompanying drawings are merely examples. An electronic-cigarette vaporization component 100 according to an embodiment of a first aspect of the present disclosure will be described below with reference to FIG. 1 to FIG. 12.

As shown in FIG. 1 to FIG. 12, the electronic-cigarette vaporization component 100 according to the embodiment of the first aspect of the present disclosure includes a housing 1 and a vaporization core fixing device 2. The housing 1 has a liquid storage cavity 111 provided therein, an outlet channel 112, and a vaporization cavity 113 in communication with the outlet channel 112. An air inlet 121 in communication with the vaporization cavity 113 and an air outlet 114 in communication with the outlet channel 112 are provided on the housing 1. The vaporization core fixing device 2 is fixed in the housing 1, i.e., the vaporization core fixing device 2 is fixedly connected with the housing 1. The fixed connection may be that the vaporization core fixing device 2 presses against an inner side wall of the housing 1. The vaporization core fixing device 2 separates the liquid storage cavity 111 and the vaporization cavity 113, and the vaporization core fixing device 2 is formed with a mounting groove 211 and a communication channel 23. The mounting groove 211 is separated from the communication channel 23. A first end of the communication channel 23 is in communication with the vaporization cavity 113, and a second end of the communication channel 23 is in communication with one end of the outlet channel 112 distant from the air outlet 114. At least a portion of the communication channel 23 is arranged obliquely with respect to the outlet channel 112. A vaporization core component 4 is arranged in the mounting groove 211. The vaporization core component 4 is in communication with the liquid storage cavity 111 and the vaporization cavity 113 respectively. The vaporization core component 4 is configured to heat and vaporize an e-liquid in the liquid storage cavity 111 to form an aerosol into the vaporization cavity 113. A user inhales through the air outlet 114. Outside air enters the vaporization cavity 113 through the air inlet 121, and is mixed with the aerosol in the vaporization cavity 113, for inhalation by the user through the outlet channel 112.

Figure 2:
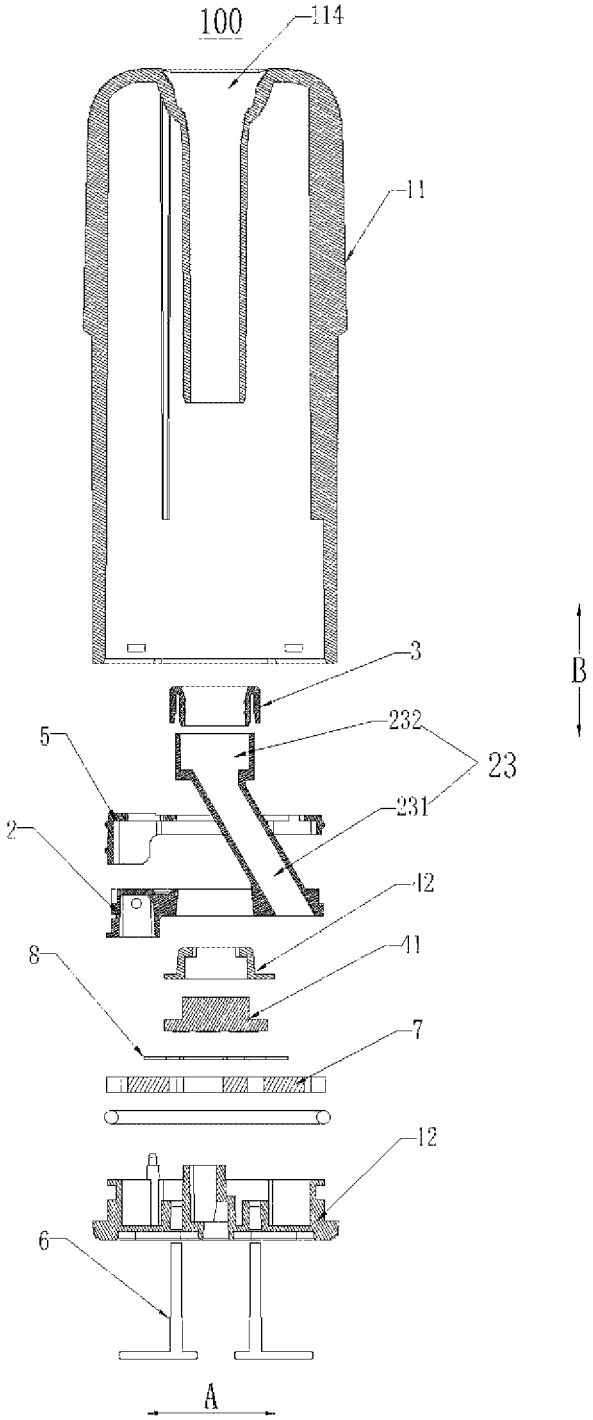
FIG. 2 is an exploded view of an electronic-cigarette vaporization component according to an embodiment of the present disclosure.

For example, in the example of FIG. 1 and FIG. 2, the outlet channel 112 may be arranged in a middle part of the housing 1, the liquid storage cavity 111 is located on an outer peripheral side of the outlet channel 112, and the liquid storage cavity 111 is configured to store the e-liquid. The vaporization core fixing device 2 is fixed in the housing 1, and the vaporization core fixing device 2 is located on one side of the outlet channel 112 close to the air inlet 121. The vaporization core component 4 is fixedly mounted in the mounting groove 211, and a shape of the mounting groove 211 matches a shape of the vaporization core 9, so as to firmly mount the vaporization core 9 on the vaporization core fixing member 2. The vaporization cavity 113 is located on one side of the vaporization core fixing device 2 distant from the liquid storage cavity 111. The e-liquid in the liquid storage cavity 111 may be heated and vaporized by the vaporization core component 4 to form an aerosol, which enters the vaporization cavity 113. The air outlet 114 is provided at a center of a top of the housing 1. The air outlet 114 is in communication with the outlet channel 112. The air inlet 121 is provided at a bottom of the housing 1 and is in communication with the vaporization cavity 113. During inhalation by the user, outside air enters the vaporization cavity 113 through the air inlet 121.

Figure 3:
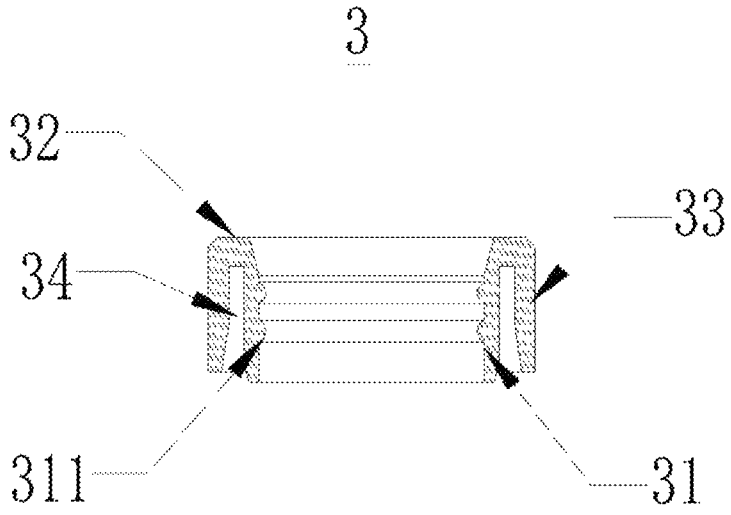
FIG. 3 is a cross-sectional view of a sealing sleeve of an electronic-cigarette vaporization component according to an embodiment of the present disclosure.
Figure 4:
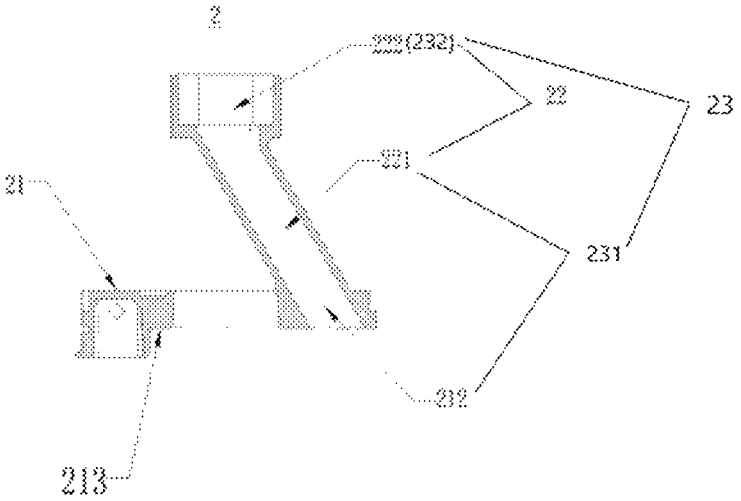
FIG. 4 is a cross-sectional view of a vaporization core fixing device of an electronic-cigarette vaporization component according to an embodiment of the present disclosure.
Figure 5:
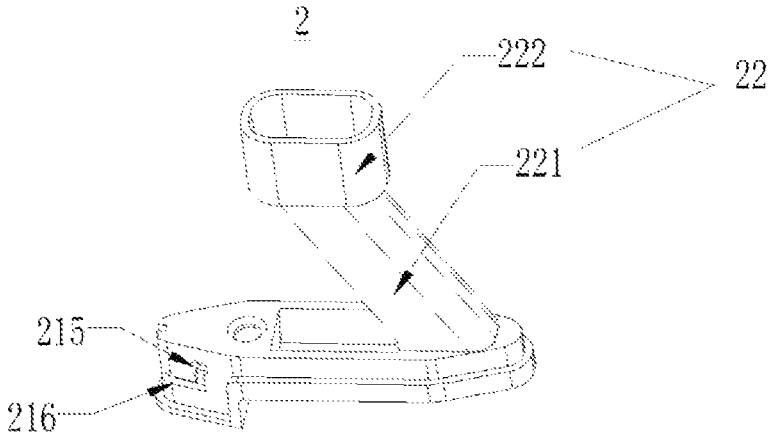
FIG. 5 is a schematic diagram of a vaporization core fixing device of an electronic-cigarette vaporization component according to an embodiment of the present disclosure.

As shown in FIG. 3 to FIG. 5, because the communication channel 23 is provided on the vaporization core fixing device 2, and at least a part of the communication channel 23 is arranged obliquely with respect to the outlet channel, the aerosol in the vaporization cavity 113 can smoothly flow to the outlet channel 112 and be inhaled through the air outlet 114, and the space required for arranging the communication channel is also reduced, thereby achieving the miniaturization design of the electronic-cigarette vaporization component.

According to an embodiment of the present disclosure, the first end of the communication channel 23 is located between the mounting groove 211 and an inner side wall of the housing 1, and a central axis of the first end of the communication channel 23 is closer to the inner side wall of the housing 1 than a central axis of the outlet channel 112 is. With such an arrangement that the communication channel 23 is arranged on the vaporization core fixing device and one end of the communication channel 23 in communication with the vaporization cavity 113 is located on one side of the mounting groove 211, the communication channel 23 of the present disclosure can save space and facilitate the miniaturization design of the electronic-cigarette vaporization component, compared with the arrangement of a separate channel for communicating the vaporization cavity 113 with the outlet channel 112 in the prior art. Moreover, compared with the arrangement of a zigzag communication channel and a curved communication channel in the prior art, the communication channel of the present disclosure makes the aerosol flow more smoothly during inhalation.

According to an embodiment of the present disclosure, the housing has a length direction, a width direction, and a thickness direction, a maximum dimension of the housing in the length direction is larger than a maximum dimension of the housing in the width direction, and the maximum dimension of the housing in the width direction is larger than or equal to a maximum dimension of the housing in the thickness direction. As shown in FIG. 1 to FIG. 2, the length direction of the housing 1 is defined as a direction B, the width direction of the housing 1 is defined as a direction A, and the thickness direction of the housing 1 is perpendicular to the length direction and the width direction, that is, the length direction, the width direction, and the thickness direction of the housing 1 are perpendicular to each other. According to an embodiment of the present disclosure, the maximum dimension of the housing 1 in the thickness direction is smaller than the maximum dimension of the housing 1 in the width direction, that is, the maximum dimension of the housing 1 in the thickness direction is the smallest, the housing 1 is flat, and the maximum dimension of the housing 1 in the length direction and the maximum dimension of the housing 1 in the width direction depend on actual situations. When the vaporization device 100 is used in an electronic cigarette as a cartridge, the length direction is generally the same as the length direction of the cigarette rod, i.e. the length direction is an extending direction from the cartridge to the cigarette rod.

Figure 6:
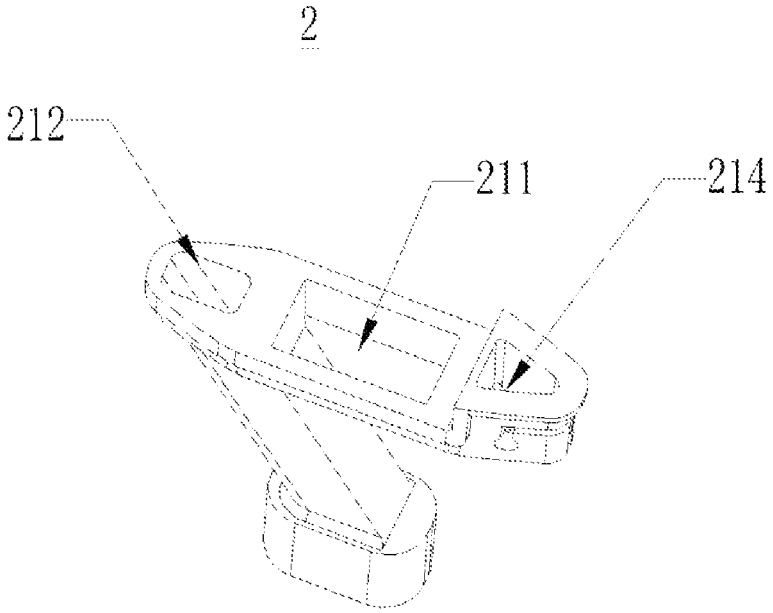
FIG. 6 is another schematic diagram of a vaporization core fixing device of an electronic-cigarette vaporization component according to an embodiment of the present disclosure.

According to an embodiment of the present disclosure, as shown in FIG. 4 to FIG. 6, the first end of the communication channel 23 is in communication with the vaporization cavity 113, and the first end of the communication channel 23 is staggered from the mounting groove 211 in the width direction of the housing 1, that is, the first end of the communication channel 23 is located on one side of the mounting groove 211 in the width direction of the housing 1, and at least a part of the communication channel 23 is inclined with respect to the outlet channel 112 in the width direction of the housing 1. The structural design where the end of the communication channel 23 in communication with the vaporization cavity 113 is provided on one side of the mounting groove 211 in the width direction and at least a part of the communication channel 23 extends toward an end of the outlet channel 112 distant from the air outlet 114 in the width direction of the housing 1 to form a communication connection allows for a smaller thickness of the housing 1 and is more in line with the user's usage habit, as compared with the arrangement of a channel for communicating the vaporization cavity 113 with the outlet channel 112 in the thickness direction of the housing 1.

According to an embodiment of the present disclosure, as shown in FIG. 4 to FIG. 6, the communication channel 23 includes a second channel segment 231 and a second connecting segment 232 in communication with each other, and the second channel segment 231 extends obliquely in the width direction of the housing 1 toward an end of the outlet channel 112 distant from the air outlet 114, that is, the second channel segment 231 is inclined in the width direction with respect to the outlet channel 112. The second connecting segment 232 is sleeved on an outer peripheral side of the end of the outlet channel 112 distant from the air outlet 114. That is, the second channel segment 231 of the communication channel 23 and the mounting groove for mounting the vaporization core component 4 are arranged in the width direction of the housing 1, and in the width direction of the housing 1, and the second channel segment 231 of the communication channel 23 extends obliquely from the vaporization core fixing device 2 toward the outlet channel 112 and is in communication with the outlet channel 112. In other words, in the width direction of the housing 1, a central axis of the second channel segment 231 forms an acute angle with the central axis of the outlet channel 112. The aerosol in the vaporization cavity 113 enters the outlet channel 112 through the communication channel 23, and the communication channel 23 does not occupy space in the thickness direction of the housing 1, so that an ultra-thin design of the housing 1 can be achieved to meet user requirements. In addition, the second channel segment 231 of the communication channel 23 is arranged obliquely in the width direction of the housing 1 with respect to the outlet channel 112, so that the aerosol in the vaporization cavity 113 can smoothly enter the outlet channel 112, thereby reducing the resistance to inhalation of the electronic cigarette, and improving user experience.

The electronic-cigarette vaporization component 100 of the present disclosure needs to be used with a cigarette rod when used in an electronic cigarette. The user inhales through the air outlet 114. In this case, a pneumatic sensor (for example, an airflow sensor) in the cigarette rod detects the inhalation, and a power source in the cigarette rod is electrically connected to the vaporization core module 4. The vaporization core module 4 starts heating. During this process, the e-liquid in the liquid storage cavity 111 is guided to the vaporization core module 4 to be heated and vaporized to form an aerosol, which enters the vaporization cavity 113. At the same time, outside air enters the vaporization cavity 113 through the air inlet 121 and is mixed with the aerosol in the vaporization cavity 113. The mixture enters the outlet channel 112 through the communication channel 221 and reaches the air outlet 114 for inhalation by the user. When the user stops inhaling through the air outlet 114, the electrical connection between the power source in the cigarette rod and the vaporization core component 4 is disconnected, and the power source stops supplying power to the vaporization core component 4. It needs to be explained herein that in some electronic cigarettes, the electronic-cigarette vaporization component 100 and the cigarette rod are configured as separate structures, which can be combined detachably, and in some electronic cigarettes, the electronic-cigarette vaporization component 100 and the cigarette rod are configured as a non-detachable structure. This is not specifically limited herein.

According to some embodiments of the present disclosure, an included angle between a central axis of the second channel segment 231 and the central axis of the outlet channel 112 ranges from 20° to 70°, and a central axis of the second connecting segment 232 coincides with the central axis of the outlet channel 112. When the included angle between the central axis of the second channel segment 231 and the central axis of the outlet channel 112 is controlled to 20°-70°, the resistance to inhalation of the electronic cigarette is minimized while satisfying the ultra-thin design of the electronic-cigarette vaporization component 100. Therefore, the flow rate of the e-liquid can be slowed down to reduce the formation of condensate such as e-liquid, to prevent the user from breathing into the e-liquid in liquid form, providing a better user experience.

According to an embodiment of the present disclosure, as shown in FIG. 4 to FIG. 6, the vaporization core fixing device 2 includes a fixing portion 21 and a channel portion 22. The mounting groove 211 is formed on the fixing portion 21, a communication hole 212 is formed in the fixing portion 21, and the communication hole 212 is located on one side of the mounting groove 211 in the width direction. The channel portion 22 is located on one side of the fixing portion 21 in the length direction, the channel portion 22 includes a first channel segment 221 and a first connecting segment 222, the first channel segment 221 and the communication hole 212 are in communication with each other to form the second channel segment 231, and the first connecting segment 222 forms the second connecting segment 232. That is to say, the channel portion 22 is in communication with the vaporization cavity 113 through the communication hole 212 provided on the fixing portion 21. According to an embodiment of the present disclosure, the fixing portion 21 and the channel portion 22 are of an integrated structure.

According to an embodiment of the present disclosure, as shown in FIG. 4 to FIG. 6, an inner wall of the communication hole 212 is inclined toward the outlet channel 112 in the width direction of the housing 1, the first channel segment 221 obliquely extends from the fixing portion 21 toward the outlet channel 112 in the width direction of the housing 1, and the inner wall of the communication hole 212 and an inner wall of the first channel segment 221 are connected to each other to form an inner wall of the second channel segment 231.

According to an embodiment of the present disclosure, a cross-sectional area of the second connecting segment 232 is larger than a cross-sectional area of the second channel segment 231.

According to an embodiment of the present disclosure, a connecting wall is connected between a side wall of the second connecting segment 232 and a side wall of the second channel segment 231, the connecting wall and the side wall of the second connecting segment 232 are perpendicular to each other, the connecting wall forms an angle with the side wall of the second channel segment 231, and an end surface of the end of the outlet channel 231 distant from the air outlet 114 presses against the connecting wall. According to an embodiment of the present disclosure, the end surface of the end of the outlet channel 112 distant from the air outlet 114 presses against the connecting wall in the length direction of the housing 1.

According to an embodiment of the present disclosure, as shown in FIG. 1 and FIG. 2, a sealing sleeve 3 is sleeved on an end of the side wall of the second connecting segment 232 facing the air outlet 114, the sealing sleeve 3 is arranged surrounding the outlet channel 112, and the sealing sleeve 3 is at least partially located between an inner wall surface of the side wall of the second connecting segment 232 and an outer wall surface of the outlet channel 112. With the arrangement of the sealing sleeve 3, the sealing effect at the joint between the communication channel 23 and the outlet channel 112 can be improved, to prevent the e-liquid from entering the outlet channel 113 through the joint and being inhaled by the user to affecting the taste of aerosol.

According to an embodiment of the present disclosure, as shown in FIG. 3, the sealing sleeve 3 includes a first sealing wall 31, a second sealing wall 33, and an end edge 32 connecting the first sealing wall 31 and the second sealing wall 33; an annular groove 34 is defined by the first sealing wall 31, the second sealing wall 33, and the end edge 32, and the side wall of the second connecting segment 232 is inserted into the annular groove.

According to an embodiment of the present disclosure, as shown in FIG. 1 to FIG. 3, the first sealing wall 31 is in interference fit with an outer wall of the outlet channel 112 and the inner wall surface of the side wall of the second connecting segment 232 respectively, the second sealing wall 33 is in interference fit with an inner wall of the housing 1 and an outer wall surface of the side wall of the second connecting segment 232 respectively in the thickness direction of the housing 1, and the end edge 32 presses against a top wall of the second connecting segment 232.

According to an embodiment of the present disclosure, as shown in FIG. 1 to FIG. 3, a sealing rib 311 is arranged on a side surface of the first sealing wall 31 facing the outlet channel 112, and the sealing rib 311 is arranged surrounding the outlet channel 112. The arrangement of the rib improves the sealing effect at the joint between the communication channel 23 and the outlet channel 112, to prevent the e-liquid in the liquid storage cavity 111 from entering the outlet channel 112 and being inhaled by the user.

According to an embodiment of the present disclosure, a cross-section of the outlet channel 112 is circular, elliptical, or racetrack-shaped.

According to an embodiment of the present disclosure, in the length direction of the housing 1, the housing 1 and the vaporization core component 4 have a central axis, and the central axis of the outlet channel 112, the central axis of the housing 1, and the central axis of the vaporization core component 4 coincide with each other. That is, the outlet channel 112 and the air outlet 114 are located at a central position of the housing 1, the end of the outlet channel 112 distant from the air outlet 114 is located exactly above the vaporization core component 4, and the communication channel 23 arranged on the mounting groove 211 in the width direction of the housing 1 extends obliquely toward the end of the outlet channel 112 distant from the air outlet 114 in the width direction, and is connected and in communication with the end of the outlet channel 112 distant from the air outlet 114. This structure allows for a smaller thickness of the housing 1 and reduces the resistance to inhalation, thereby providing a good user experience.

According to an embodiment of the present disclosure, in the length direction of the housing 1, the housing 1 and the vaporization core component 4 have a central axis, the central axis of the housing 1 coincides with the central axis of the vaporization core component 4, the central axis of the outlet channel 112 is deviated by a predetermined distance from the central axis of the housing 1 and the central axis of the vaporization core component 4, and the first end of the communication channel 23 is located on one side of the mounting groove 211 distant from the outlet channel 112 in the width direction of the housing 1. That is, the outlet channel 112 is not located at the central position of the housing 1, but is offset toward the inner side wall of the housing 1 by a predetermined distance in the width direction of the housing 1. In this case, the end of the communication channel 23 in communication with the vaporization cavity 113 is located on one side of the mounting groove 211 distant from the outlet channel 112.

According to an embodiment of the present disclosure, as shown in FIG. 1, FIG. 2, and FIG. 9 to FIG. 11, the vaporization core component 4 includes: a vaporization core 41 and a vaporization-core sealing member 42. The vaporization core 41 includes a porous body 411 and a heating element 412 arranged on the porous body. The porous body 411 includes a liquid guiding portion 4111 and a vaporization portion 4112. The liquid guiding portion 4111 is in communication with the liquid storage cavity 111. The vaporization portion 4112 is in communication with the vaporization cavity 113. A projected area of the liquid guiding portion 4111 is smaller than a projected area of the vaporization portion 4112 in a direction perpendicular to the length direction of the housing 1. A step surface 4113 is formed between the liquid guiding portion 4111 and the vaporization portion 4112. The vaporization-core sealing member 42 is sleeved on an outer peripheral edge of the porous body 411. The vaporization-core sealing member 42 includes a first sealing edge 421, a second sealing edge 423, and a sealing connecting portion 422 connected between the first sealing edge 421 and the second sealing edge 423. The first sealing edge 421 covers an outer edge of a side surface of the liquid guiding portion 4111 facing the liquid storage cavity 111. The second sealing edge 423 covers the step surface 4113. The sealing connecting portion 422 covers a side surface of the liquid guiding portion 4111. The side surface of the liquid guiding portion 4111 refers to a side surface of a side wall of the liquid guiding portion 4111 facing the housing 1; With the use of the porous body 411 having this configuration in the vaporization core 41, the porous body 411 includes the liquid guiding portion 4111 and the vaporization portion 4112. The side surface of the liquid guiding portion 4111 facing the liquid storage cavity 111 is a liquid absorption surface. The liquid absorption surface is in communication with the liquid storage cavity 111 through the vaporization core fixing device 2 and a liquid hole on the first sealing member 5. A side surface of the vaporization portion 4112 distant from the liquid guiding portion 4111 is a vaporization surface. The heating element 412 is arranged on the vaporization surface. The projected area of the liquid guiding portion 4111 is smaller than the projected area of the vaporization portion 4112 in the direction perpendicular to the length direction of the housing 1. According to an embodiment of the present disclosure, in the vaporization core component 4, the liquid absorption surface is arranged opposite to the vaporization surface, and an area of the liquid absorption surface is smaller than an area of the vaporization surface, so that the e-liquid absorbed by the liquid absorption surface can fully penetrate into the surface of the vaporization region on the vaporization surface, to prevent the e-liquid absorbed by the liquid absorption surface from gathering in the region outside the vaporization region on the vaporization surface and being inhaled by the user due to excessively quick penetration. This improves the efficiency of the e-liquid absorption in the liquid absorption region, ensures the purity of aerosol generated by the vaporization core component, and prevents e-liquid leakage, thereby improving the taste of aerosol.

According to an embodiment of the present disclosure, in the length direction of the housing 1, the liquid guiding portion and the vaporization portion each have a thickness dimension, the thickness dimension of the liquid guiding portion is 0.5 mm to 5 mm, and the thickness dimension of the vaporization portion is 0.3 mm to 3 mm.

According to an embodiment of the present disclosure, a stop portion 213 is constructed on a side wall of the mounting groove 211, and the stop portion 213 is stopped against a side surface of the second sealing edge 423 facing the outlet channel 112 in the length direction of the housing 1. With the arrangement of the stop portion 213, the vaporization core component 4 can be fixed.

According to an embodiment of the present disclosure, as shown in FIG. 4 to FIG. 6, the vaporization core fixing device 2 further includes an air exchange cavity 214, the air exchange cavity 214 and the communication hole 212 are located on two sides of the mounting groove 211 in the width direction of the housing 1, an air exchange through hole 215 is formed on a cavity wall of the air exchange cavity 214, the air exchange cavity 214 is in communication with the vaporization cavity 113 through the air exchange through hole 215, an air exchange groove 216 is formed on an outer peripheral surface of one side, where the air exchange cavity 214 is provided, of the vaporization core fixing device 2, one end of the air exchange groove 216 is connected with the air exchange through hole 215, and another end of the air exchange groove 216 runs through a side surface of the vaporization core fixing device facing the liquid storage cavity 111 to be in communication with the liquid storage cavity 111. The electronic-cigarette vaporization component 100 further includes a first sealing member 5, the first sealing member 5 is sleeved on the vaporization core fixing device 2, the first sealing member 5 is at least partially located between an inner wall surface of the housing 1 and the vaporization core fixing device 2, and an air exchange channel is defined jointly by the air exchange through hole, the air exchange groove, and the first sealing member. When the pressure in the vaporization cavity 113 is greater than the pressure in the liquid storage cavity 111, the air exchange channel is opened under the pressure difference between the vaporization cavity 113 and the liquid storage cavity 111 to reduce the pressure in the vaporization cavity 113, so that the e-liquid in the liquid storage cavity 111 can smoothly flow to the vaporization core component 4. When the pressure in the vaporization cavity 113 is not greater than the pressure in the liquid storage cavity 111, indicating a pressure balance between the liquid storage cavity 111 and the vaporization cavity 113, the air exchange channel is closed, to prevent the e-liquid in the liquid storage cavity 111 from entering the vaporization cavity through the air exchange channel, i.e., to prevent e-liquid leakage. Therefore, the pressure difference between the liquid storage cavity 111 and the vaporization cavity 113 can be effectively adjusted through the air exchange channel, so that the pressure in the liquid storage cavity 111 can be greater than the pressure in the vaporization cavity 113, to ensure that the e-liquid can smoothly flow to the vaporization core component 4 and be effectively vaporized.

According to an embodiment of the present disclosure, the air exchange through hole 215 is formed on one side of the vaporization core fixing device 2 in the thickness direction of the housing 1, a part of the air exchange groove 216 extends to another side of the vaporization core fixing device 2 in the thickness direction of the housing 1, and the another end of the air exchange groove 216 is located at one end of the vaporization core fixing device 2 in the width direction of the housing 1.

According to an embodiment of the present disclosure, as shown in FIG. 5, a position of connection between the air exchange groove 216 and the air exchange through hole 215 is distant from the liquid storage cavity 111 relative to the air exchange through hole 215. By such a configuration, when the e-liquid in the liquid storage cavity 111 flows into the air exchange groove 216 and enters the vaporization cavity 113 through the air exchange through hole 215, the flow of the e-liquid from the air exchange groove 216 to the air exchange through hole 215 is from a "lower position" to a "higher position" because the air exchange through hole 215 is at a higher position and is closer to the liquid storage cavity 111. In this way, the e-liquid in the liquid storage cavity 111 can be prevented from flowing into the vaporization cavity 113 through the air exchange groove 216 and the air exchange through hole 215, thereby preventing the e-liquid from being inhaled by the user.

Figure 7:
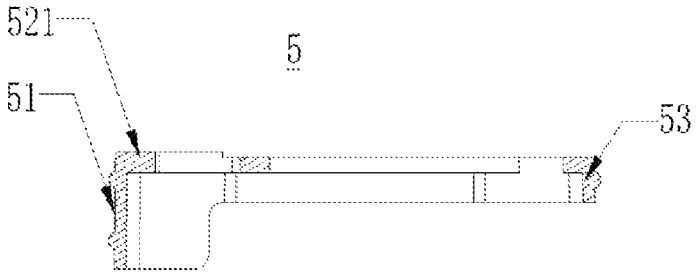
FIG. 7 is a cross-sectional view of a vaporization-core sealing member of an electronic-cigarette vaporization component according to an embodiment of the present disclosure.
Figure 8:
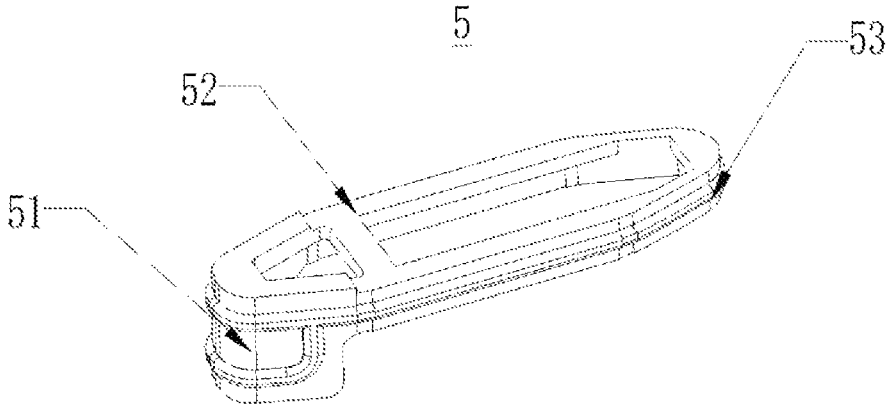
FIG. 8 is a schematic diagram of a vaporization-core sealing member of an electronic-cigarette vaporization component according to an embodiment of the present disclosure.
Figure 9:
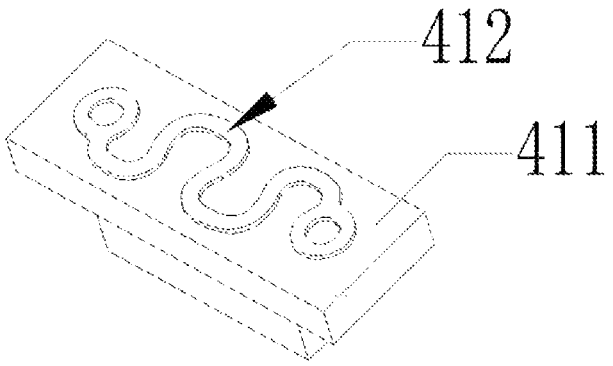
FIG. 9 is a schematic diagram of a vaporization core of an electronic-cigarette vaporization component according to an embodiment of the present disclosure.
Figure 10:
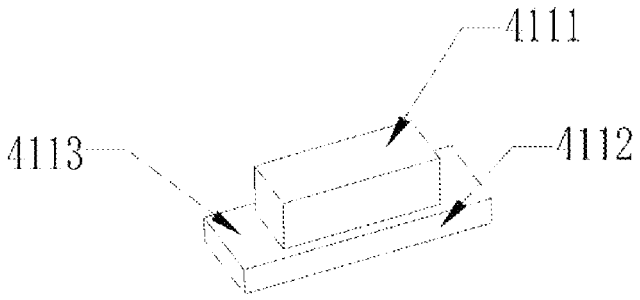
FIG. 10 is another schematic diagram of a vaporization core of an electronic-cigarette vaporization component according to an embodiment of the present disclosure.
Figure 11:
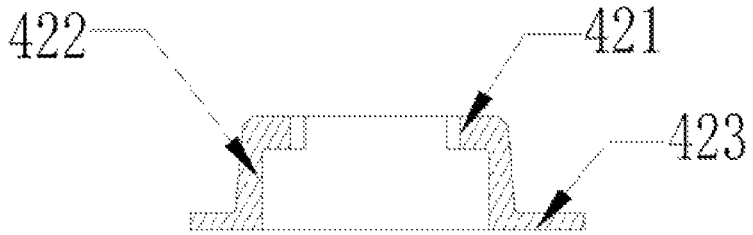
FIG. 11 is a cross-sectional view of a vaporization-core sealing member of an electronic-cigarette vaporization component according to an embodiment of the present disclosure.

According to an embodiment of the present disclosure, as shown in FIG. 7 to FIG. 8, the first sealing member 5 includes: a sealing end portion 52, where the sealing end portion 52 covers at least an edge portion of the side surface of the vaporization core fixing device 2 facing the liquid storage cavity 111; and a first sealing portion 51 and a second sealing portion 53, where the first sealing portion 51 and the second sealing portion 53 are both connected with the sealing end portion 52 and are located on an outer peripheral side of the vaporization core fixing device 2, the air exchange channel is provided between the first sealing portion 51 and the vaporization core fixing device 2, and a maximum dimension of the second sealing portion 53 in the length direction of the housing 1 is smaller than a maximum dimension of the first sealing portion 51 in the length direction of the housing 1.

According to an embodiment of the present disclosure, as shown in FIG. 7 to FIG. 8, the sealing end portion 52 includes at least one air exchange elastic portion 521; the at least one air exchange elastic portion 521 covers one end of the air exchange channel facing the liquid storage cavity 111; when a pressure in the vaporization cavity 113 is greater than a pressure in the liquid storage cavity 111, the air exchange elastic portion 521 deforms under a pressure difference between the vaporization cavity 113 and the liquid storage cavity 111 to open the air exchange channel; and when the pressure in the vaporization cavity 113 is not greater than the pressure in the liquid storage cavity 521, the air exchange channel is blocked by the air exchange elastic portion, to prevent the e-liquid in the liquid storage cavity 111 from entering the vaporization cavity 113 to cause e-liquid leakage.

According to an embodiment of the present disclosure, as shown in FIG. 1, a stop step 115 is provided on an inner wall surface of one side of the housing 1 close to the first sealing portion 51, and on one side of the housing close to the communication hole 212, a side surface of the sealing end portion 52 facing the air outlet 114 is stopped against the stop step. With the arrangement of the stop step, the fixing of the vaporization core fixing device 2 in the housing 1 can be strengthened, thereby fixing the vaporization core component 4.

According to an embodiment of the present disclosure, as shown in FIG. 1 to FIG. 2, a protruding bar is provided on an inner wall surface of one side of the housing 1 close to the second sealing portion 53, and the protruding bar presses against the sealing end portion 52 in the length direction of the housing 1.

Figure 12:
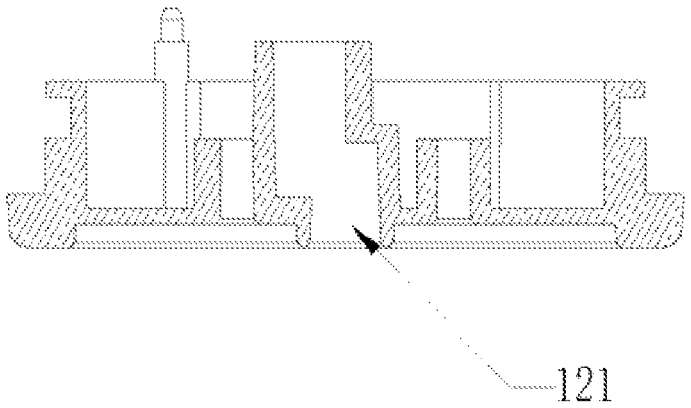
FIG. 12 is a cross-sectional view of a lower cover of an electronic-cigarette vaporization component according to an embodiment of the present disclosure.

According to an embodiment of the present disclosure, as shown in FIG. 1, FIG. 2, and FIG. 12, the housing 1 includes: a housing body 11, where the outlet channel 112 is provided in the housing body 11, one end of the housing body 11 is provided with an opening, and another end of the housing body 11 is provided with the air outlet 114; and a lower cover 12, where the lower cover 12 is arranged at the opening, the vaporization cavity 113 is defined jointly by the housing body 11, the vaporization core component 4, and the lower cover 12, the lower cover 12 includes a bottom wall and a side wall extending from the bottom wall toward the vaporization cavity 113, the bottom wall of the lower cover 12 is provided with an inlet channel, the inlet channel includes an air intake hole and an air outlet, the air intake hole forms the air inlet 121, and the air outlet is deviated in a direction away from the communication hole relative to the air intake hole. During operation of the vaporization component 100, outside air enters the inlet channel through the air intake hole, flows to the vaporization cavity 113 from the air outlet, and after being mixed with the aerosol in the vaporization cavity 113, flows to the user's mouth through the outlet channel 12 and the air outlet 114. Therefore, the flow path of the air in the vaporization cavity 13 can be increased so that the air can be fully mixed with the aerosol.

According to an embodiment of the present disclosure, as shown in FIG. 1, an edge of one side of the second sealing edge 423 of the vaporization-core sealing member 42 close to the communication channel 23 has a shielding portion extending in the length direction of the housing 1, the shielding portion extends into the vaporization cavity 113, and the shielding portion is arranged at a communication position between the vaporization cavity 113 and the communication channel 23, to limit an airflow at the communication position. The shielding portion may block a mixed airflow flowing from the vaporization cavity 113 toward the outlet channel 112 to slow down the flow of the mixed airflow, so that the aerosol and air in the mixed airflow can be fully mixed in the vaporization cavity 113.

According to an embodiment of the present disclosure, as shown in FIG. 1 and FIG. 2, the bottom wall of the lower cover 12 is provided with a conductive pin 6, an e-liquid guide cotton 7 is supported by the side wall of the lower cover 12, the conductive pin 6 penetrates the e-liquid guide cotton 7 and presses against the vaporization core component 4 to electrically connect to the vaporization core component 4, the e-liquid guide cotton 7 has a vent hole, and a position of the vent hole corresponds to a position of the air outlet 114. The conductive pin presses against the vaporization core component. The protruding bar on the inner side wall of the housing 1 close to the first sealing member 5 and the stop step 115 on the side of the housing 1 close to the second sealing member 53 press against two sides of the sealing end portion of the first sealing member 5 in the width direction from above respectively. The conductive pin presses against the vaporization core component from below. Whereby, the vaporization core component is fixed by vertical clamping.

According to an embodiment of the present disclosure, the electronic-cigarette vaporization component further includes an air-guiding metal plate 8. The air-guiding metal plate 8 is arranged on a side surface of the e-liquid guide cotton 7 facing the vaporization core component 4, the air-guiding metal plate 8 covers the air outlet, and the air-guiding metal plate 8 is provided with a plurality of air splitting holes at a position corresponding to the air outlet.

According to an embodiment of the present disclosure, the air guide metal plate 8 is provided with a notch at a position exactly facing the air exchange cavity 214 and the communication hole. With the arrangement of the notch structure, the condensed e-liquid can drip onto the e-liquid guide cotton 7 through the notch at the corresponding position through which the airflow passes, and be absorbed by the e-liquid guide cotton 7, thereby reducing e-liquid leakage.

An embodiment of a second aspect of the present disclosure provides an electronic cigarette (not shown), including the electronic-cigarette vaporization component 100 according to the embodiment of the first aspect of the present disclosure.

By adopting the electronic-cigarette vaporization component 100, the electronic cigarette according to the embodiment of the present disclosure can reduce the resistance to inhalation of the electronic cigarette while satisfying the miniaturization design of the housing 1.

Other configurations and operations of the electronic cigarette according to the embodiments of the disclosure are known to those of ordinary skill in the art, and are not described in detail herein again.

In the description of the present disclosure, it should be understood that orientation or position relationships indicated by the terms such as "center", "length", "width", "thickness", "on", "below", "front", "rear", "left", "right", "vertical", "horizontal", "top", "bottom", "inner", "outer", "axial", "radial", and "circumferential" are based on orientation or position relationships shown in the accompanying drawings, and are used only for ease and brevity of illustration and description, rather than indicating or implying that the mentioned apparatus or component need to have a particular orientation or need to be constructed and operated in a particular orientation. Therefore, such terms should not be construed as limiting of the present disclosure.

In the description of the present disclosure, it should be noted that, unless otherwise clearly specified and defined, the terms "mount", "connect", "couple", and variants thereof should be interpreted in a broad sense, for example, may be a fixed connection, a detachable connection, or an integral connection; may be a mechanical connection or an electrical connection; or may be a direct connection, an indirectly connection via an intermediate medium, or communication between the interiors of two components. For those of ordinary skill in the art, the specific meanings of the above terms in the present disclosure can be understood according to specific circumstances.

In the description of the specification, the description with reference to the terms "an embodiment", "some embodiments", "exemplary embodiments", "example", "specific example", or "some example" and so on means that specific features, structures, materials or characteristics described in connection with the embodiment or example are embraced in at least one embodiment or example of the present disclosure. In this specification, exemplary descriptions of the foregoing terms do not necessarily refer to the same embodiment or example.

Although the embodiments of the present disclosure have been shown and described, a person of ordinary skill in the art should understand that various changes, modifications, replacements and variations may be made to the embodiments without departing from the principles and spirit of the present disclosure, and the scope of the present disclosure is as defined by the appended claims and their equivalents.

What is claimed is:

1. An electronic-cigarette vaporization component, comprising:

a housing, wherein the housing has a liquid storage cavity provided therein, an outlet channel, and a vaporization cavity in communication with the outlet channel, and an air inlet communicating with the vaporization cavity and an air outlet in communication with the outlet channel are provided on the housing;

a vaporization core fixing device, wherein the vaporization core fixing device is fixed in the housing, the liquid storage cavity is separated from the vaporization cavity by the vaporization core fixing device, the vaporization core fixing device is provided with a mounting groove and a communication channel, the mounting groove and the communication channel are spaced apart, a first end of the communication channel is in communication with the vaporization cavity, a second end of the communication channel is in communication with an end of the outlet channel distant from the air outlet, and at least a portion of the communication channel is arranged obliquely with respect to the outlet channel; and a vaporization core component, wherein the vaporization core component is mounted in the mounting groove, and the vaporization core component is in communication with the liquid storage cavity and the vaporization cavity respectively, wherein the housing has a length direction, a width direction, and a thickness direction, a maximum dimension of the housing in the length direction is larger than a maximum dimension of the housing in the width direction, and the maximum dimension of the housing in the width direction is larger than or equal to a maximum dimension of the housing in the thickness direction, wherein the vaporization core fixing device comprises:

a fixing portion, wherein the mounting groove is formed on the fixing portion, a communication hole is formed in the fixing portion, and the communication hole is located on one side of the mounting groove in the width direction; and a channel portion, wherein the channel portion is located on one side of the fixing portion in the length direction, the channel portion comprises a first channel segment and a first connecting segment, the first channel segment and the communication hole are in communication with each other to form a second channel segment of the communication channel, and the first connecting segment forms a second connecting segment of the communication channel.

2. The electronic-cigarette vaporization component according to claim 1, wherein the first end of the communication channel is located between the mounting groove and an inner side wall of the housing, and a central axis of the first end of the communication channel is closer to the inner side wall of the housing than a central axis of the outlet channel is.

3. The electronic-cigarette vaporization component according to claim 1, wherein in the width direction, the first end of the communication channel is located on one side of the mounting groove, and the portion of the communication channel is arranged obliquely with respect to the outlet channel in the width direction.

4. The electronic-cigarette vaporization component according to claim 1, wherein the communication channel comprises the second channel segment and the second connecting segment in communication with each other, and the second channel segment is inclined in the width direction with respect to the outlet channel; and the second connecting segment is sleeved on an outer peripheral side of the end of the outlet channel distant from the air outlet;

wherein an included angle between a central axis of the second channel segment and a central axis of the outlet channel ranges from 20° to 70°, and a central axis of the second connecting segment coincides with the central axis of the outlet channel;

wherein a cross-sectional area of the second connecting segment is larger than a cross-sectional area of the second channel segment;

wherein a connecting wall is connected between a side wall of the second connecting segment and a side wall of the second channel segment, and an end surface of the end of the outlet channel distant from the air outlet presses against the connecting wall; and wherein a sealing sleeve is sleeved on the side wall of the second connecting segment, the sealing sleeve is arranged surrounding the outlet channel, and the sealing sleeve is at least partially located between an inner wall surface of the side wall of the second connecting segment and an outer wall surface of the outlet channel.

5. The electronic-cigarette vaporization component according to claim 1, wherein an inner wall of the communication hole is inclined toward the outlet channel in the width direction, the first channel segment obliquely extends from the fixing portion toward the outlet channel in the width direction, and the inner wall of the communication hole and an inner wall of the first channel segment are connected to each other to form an inner wall of the second channel segment.

6. The electronic-cigarette vaporization component claim 4, wherein the sealing sleeve comprises a first sealing wall, a second sealing wall, and an end edge connecting the first sealing wall and the second sealing wall; an annular groove is defined by the first sealing wall, the second sealing wall, and the end edge, and the side wall of the second connecting segment is inserted into the annular groove, wherein the first sealing wall is in interference fit with an outer wall of the outlet channel and the inner wall surface of the side wall of the second connecting segment respectively, the second sealing wall is in interference fit with an inner wall of the housing and an outer wall surface of the side wall of the second connecting segment respectively in the thickness direction of the housing, and the end edge presses against a top wall of the second connecting segment, and wherein a sealing rib is arranged on a side surface of the first sealing wall facing the outlet channel, and the sealing rib is arranged surrounding the outlet channel.

7. The electronic-cigarette vaporization component according to claim 1, wherein a cross-section of the outlet channel is circular, or elliptical.

8. The electronic-cigarette vaporization component according to claim 1, wherein in the length direction, the housing and the vaporization core component have a central axis, and a central axis of the outlet channel, the central axis of the housing, and the central axis of the vaporization core component coincide with each other.

9. The electronic-cigarette vaporization component according to claim 1, wherein in the length direction, the housing and the vaporization core component have a central axis, the central axis of the housing coincides with the central axis of the vaporization core component, a central axis of the outlet channel is deviated by a distance from the central axis of the housing and the central axis of the vaporization core component, and the first end of the communication channel is located on one side of the mounting groove distant from the outlet channel in the width direction.

10. The electronic-cigarette vaporization component according to claim 1, wherein the vaporization core component comprises:

a vaporization core, wherein the vaporization core comprises a porous body and a heating element arranged on the porous body, the porous body comprises a liquid guiding portion and a vaporization portion, the liquid guiding portion is in communication with the liquid storage cavity, the vaporization portion is in communication with the vaporization cavity, a projected area of the liquid guiding portion is smaller than a projected area of the vaporization portion in a direction perpendicular to the length direction, and a step surface is formed between the liquid guiding portion and the vaporization portion; and a vaporization-core sealing member, wherein the vaporization-core sealing member is sleeved on an outer peripheral edge of the porous body, the vaporization-core sealing member comprises a first sealing edge, a second sealing edge, and a sealing connecting portion connected between the first sealing edge and the second sealing edge, the first sealing edge covers an outer edge of a side surface of the liquid guiding portion facing the liquid storage cavity, the second sealing edge covers the step surface, and the sealing connecting portion covers a side surface of the liquid guiding portion.

11. The electronic-cigarette vaporization component according to claim 10, wherein in the length direction, the liquid guiding portion and the vaporization portion each have a thickness dimension, the thickness dimension of the liquid guiding portion is 0.5 mm to 5 mm, and the thickness dimension of the vaporization portion is 0.3 mm to 3 mm.

12. The electronic-cigarette vaporization component according to claim 10, wherein a stop portion is constructed on a side wall of the mounting groove, and the stop portion is stopped against a side surface of the second sealing edge facing the outlet channel in the length direction.

13. The electronic-cigarette vaporization component according to claim 1, wherein the vaporization core fixing device further comprises an air exchange cavity, the air exchange cavity and the communication hole are located on two sides of the mounting groove in the width direction, an air exchange through hole is formed on a cavity wall of the air exchange cavity, the air exchange cavity is in communication with the vaporization cavity through the air exchange through hole, an air exchange groove is formed on an outer peripheral surface of one side of the vaporization core fixing device where the air exchange cavity is provided, one end of the air exchange groove is connected with the air exchange through hole, and another end of the air exchange groove runs through a side surface of the vaporization core fixing device facing the liquid storage cavity to be in communication with the liquid storage cavity.

14. The electronic-cigarette vaporization component according to claim 13, wherein the air exchange through hole is formed on one side of the vaporization core fixing device in the thickness direction, a part of the air exchange groove extends to another side of the vaporization core fixing device in the thickness direction, and the another end of the air exchange groove is located at one end of the vaporization core fixing device in the width direction.

15. The electronic-cigarette vaporization component according to claim 1, wherein the housing comprises:

a housing body, wherein the outlet channel is provided in the housing body, one end of the housing body is provided with an opening, and another end of the housing body is provided with the air outlet; and a lower cover, wherein the lower cover is arranged at the opening, the vaporization cavity is defined jointly by the housing body, the vaporization core component, and the lower cover, the lower cover comprises a bottom wall and a side wall extending from the bottom wall toward the vaporization cavity, the bottom wall of the lower cover is provided with an inlet channel, the inlet channel comprises an air intake hole and an air outlet, the air intake hole forms the air inlet, and the air outlet is deviated in a direction away from the communication hole relative to the air intake hole.

16. The electronic-cigarette vaporization component according to claim 15, wherein the bottom wall of the lower cover is provided with a conductive pin, an e-liquid guide cotton is supported by the side wall of the lower cover, the conductive pin penetrates the e-liquid guide cotton and presses against the vaporization core component to electrically connect to the vaporization core, the e-liquid guide cotton has a vent hole, and a position of the vent hole corresponds to a position of the air outlet, wherein the electronic-cigarette vaporization component further comprises an air-guiding metal plate, wherein the air-guiding metal plate is arranged on a side surface of the e-liquid guide cotton facing the vaporization core component, the air-guiding metal plate covers the air outlet, and the air-guiding metal plate is provided with a plurality of air splitting holes at a position corresponding to the air outlet, and wherein the air-guiding metal plate is provided with a notch at a position facing the air exchange cavity and the communication hole.

17. An electronic cigarette, comprising the electronic-cigarette vaporization component according to claim 1.

* * * * *